US008250980B1

(12) United States Patent
Mackie-Smith et al.

(10) Patent No.: US 8,250,980 B1
(45) Date of Patent: Aug. 28, 2012

(54) RELEASE MECHANISM APPARATUS

(75) Inventors: James Mackie-Smith, Hughesville, MD (US); Edward Tersine, Indian Head, MD (US); Ryan Barrow, Issue, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 213 days.

(21) Appl. No.: 12/802,451

(22) Filed: May 20, 2010

(51) Int. Cl.
*F42C 15/00* (2006.01)
*C06C 5/06* (2006.01)

(52) U.S. Cl. ..... 102/204; 102/275.11; 102/260

(58) Field of Classification Search ..... 102/200, 102/204, 258, 260, 261, 275.11; 89/27.12, 89/27.14

See application file for complete search history.

(56) References Cited

U.S. PATENT DOCUMENTS

| | | | | |
|---|---|---|---|---|
| 3,831,521 | A | 8/1974 | Engeli | |
| 4,202,269 | A * | 5/1980 | Messineo et al. | 102/204 |
| 4,338,861 | A | 7/1982 | Rhodes et al. | |
| 4,479,436 | A * | 10/1984 | Wilson | 102/275.11 |
| 5,003,861 | A * | 4/1991 | Joset | 89/1.55 |
| 5,005,482 | A | 4/1991 | Reams | |
| 7,490,554 | B2 * | 2/2009 | Lynch et al. | 102/275.11 |
| 2008/0057298 | A1 | 3/2008 | Finley | |

* cited by examiner

*Primary Examiner* — James Bergin
(74) *Attorney, Agent, or Firm* — Fredric J. Zimmerman

(57) ABSTRACT

An exemplary firing pin with a release mechanism apparatus at least partially composed of an elastic thermoplastic material. The apparatus includes a rod with a first end portion, a middle portion, and a second end portion. The first end portion includes an integral cage-like element with a plurality of restraining wall elements, which, interiorly, are undercut defining an interior chamber with a volume sufficient to accommodate a cable stop element and define an aperture in communication with the chamber. The aperture is sized to accommodate a cable or the like, but small enough to prevent the stop element seated in the chamber from moving, so long as the restraining wall elements are constrained. The restraining wall elements are generally constrained by a substantially rigid element, such that they cannot deform, flaring open, even if the cable is under tension.

20 Claims, 3 Drawing Sheets

RELEASE MECHANISM APPARATUS

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The present invention relates to release mechanisms, and in particular to apparatus where normally metal materials are required to achieve the desired level of performance, where the invented apparatus may be composed entirely of an elastic thermoplastic material.

2. Related Art

Release mechanism apparatus in firing pins are designed to safely deliver the fire energy to the primer in an energetic device, such as a shell or a mine. The release mechanism apparatus must not fire or release under no fire conditions and must reliably work in all environmental conditions, and in the case of military devices, the environmental conditions may be very extreme.

Release mechanism apparatus, and in particular traditional firing pin, have been made of various metals, most notably aluminum and stainless steel. Some examples include shear, sear or three ball release systems. All three systems have trouble with friction in the axial direction because metal to metal contact occurs. To reduce the friction, high surface finishes or post manufacturing lubrication is required such as dry film lube. Extra material finishing and complexity greatly increases cost of manufacturing as well as inspection and rework. These features are critical to the successful functioning of the end item. Friction causes gouging, and may result in release failure.

The shear mechanisms use a shear pin that must be broken upon the specified load. While simple in design, the shear pin is strongly affected by the variance in the strength of materials of the pin and its geometry. The shear pin may also bind or press against an inner bore of the device creating energy loss in the firing pin action.

SUMMARY OF THE INVENTION

In an exemplary embodiment of the invention, the invention is a release mechanism apparatus that is at least partially composed of an elastic thermoplastic material. The apparatus includes a rod with a first end portion, a middle portion, and a second end portion. The first end portion has an integral cage-like element that includes a plurality of restraining wall elements, which, interiorly, are undercut defining an interior chamber with a volume sufficient to accommodate a cable stop element and define an aperture in communication with the interior chamber. The aperture is sized such that it can accommodate a cable or the like, but small enough to prevent the cable stop element in the chamber from passing past the aperture while the plurality of restraining wall elements are constrained. The restraining wall elements are generally constrained by a substantially rigid element, such that they cannot deform, flaring open, even if the cable is under tension.

Generally, the rod is seated in a restraining element having an axial bore, which provides the substantially rigid element. The bore has at least two regions, a first region that constrains the restraining wall elements of the cage-like element to a closed position (non-releasing), and a second region having an enlarged geometry, where the restraining wall elements may elastically deform to an open position (releasing position). Upon deformation, the volume of the chamber and the size of the aperture is increased sufficiently to release a connected cable terminated with an attached stop element.

Exemplary applications include lanyards, which may be released under a variety of operating (adverse) conditions, firing pins for mines, quick release lines, and parachute harnesses.

The disclosed invention reduces the cost of fabrication of most release mechanisms, and may be fabricated using materials known to have excellent weathering properties.

BRIEF DESCRIPTION OF THE DRAWINGS

The foregoing invention will become readily apparent by referring to the following detailed description and the appended drawings in which.

DETAILED DESCRIPTION OF THE INVENTION

The illustrated invention is a release mechanism apparatus that is at least partially composed of an elastic thermoplastic material that desirably has good weathering properties and does not creep. An exemplary suitable thermoplastic is polyetheretherketone, better known as ("PEEK"). The thermoplastic is generally selected to have a relatively low coefficient of friction, such that gouging does not occur as observed with metals, and is relatively inexpensive to mold and machine. Applications for the release mechanism apparatus include lanyards, which may be released under a variety of operating (adverse) conditions, firing pins for mines, quick release lines, and parachute harnesses. In the exemplary embodiment, the release mechanism apparatus is an integral component of a firing pin, but could be adapted for other devices.

Figure 1:
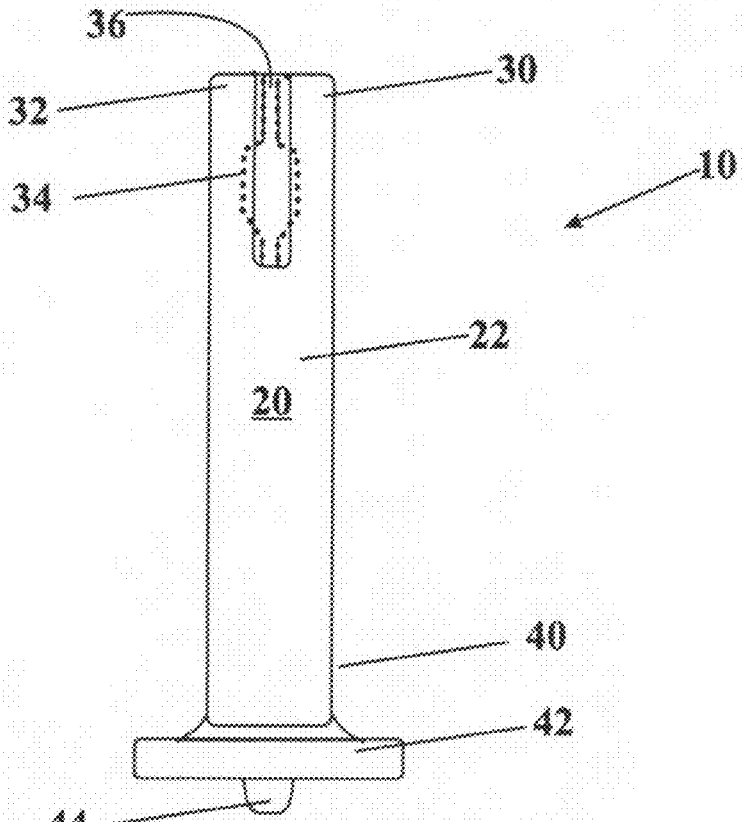
FIG. 1 is a side view of a release mechanism apparatus that is an integral component of a firing pin.
Figure 4:
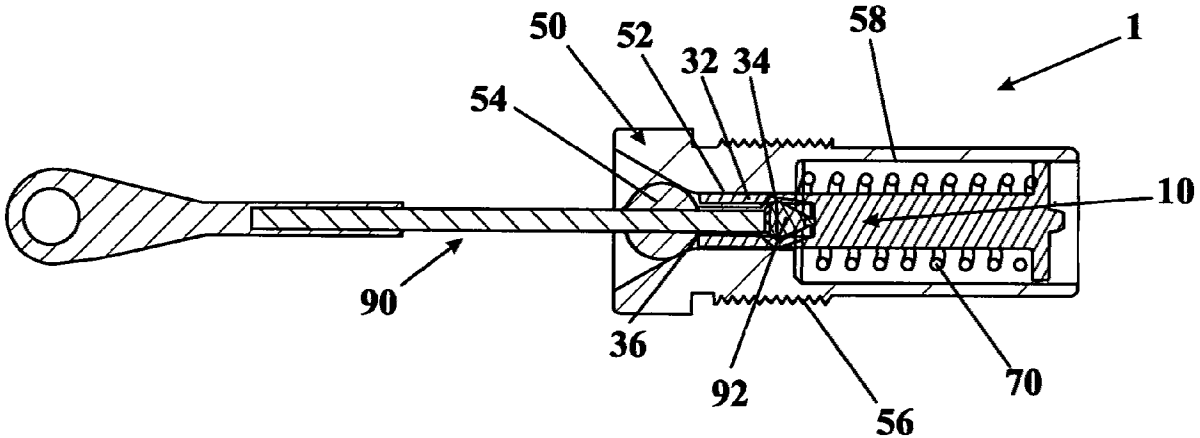
FIG. 4 is a longitudinal cross-sectional view of the firing pin with an invented release mechanism apparatus seated in a restraining element, where the apparatus has a cable with an attached stop element that is secured and the firing pin is positioned in a pre-released, unloaded position.
Figure 5:
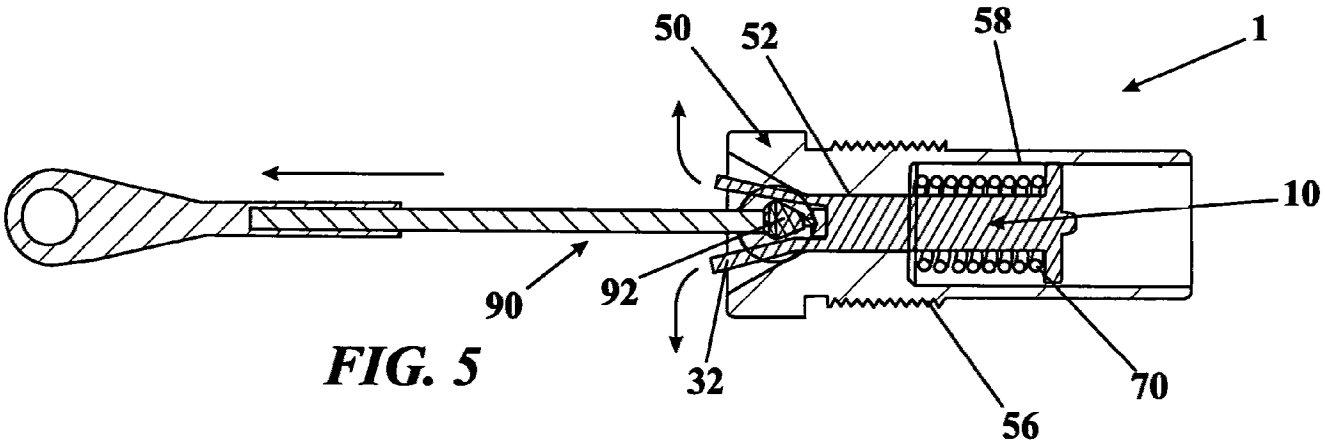
FIG. 5 is the release mechanism apparatus illustrated in FIG. 4, where the firing pin is cocked, and the plurality of restraining wall elements of the apparatus are flexed outward, therein releasing the cable.

Referring to FIG. 1, which is a side view of the release mechanism apparatus 10 that is an integral component of a firing pin 1, as illustrated in FIG. 4 and FIG. 5. The apparatus 10 includes a rod 20 with a first end portion 30, a middle portion 22, and a second end portion 40. The first end portion 30 has an integral cage-like element 34 that include a plurality of restraining wall elements 32, which, interiorly, are undercut defining an interior chamber/cage with a volume sufficient to accommodate a cable stop element and define an aperture 36 which is in communication with the cage-like element 34. The aperture 36 is sized such that it can accommodate a cable or the like, but small enough to prevent the cable stop element in the chamber from passing past the aperture 36 while the plurality of restraining wall elements 32 are constrained. Three restraining wall elements 32 are illustrated but, in an exemplary embodiment, as little as two may also work, and the upper limit is defined by the practical limitations of exceeding three or more restraining wall elements 32. The restraining wall elements are generally constrained by a substantially rigid element, such that they cannot deform, flaring open, even if the cable is under tension.

Figure 2:
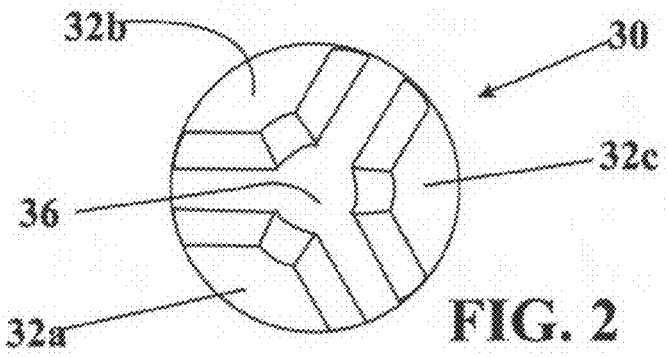
FIG. 2 is an enlarged overhead view of a first end portion of the release mechanism apparatus.

Referring to FIG. 2, which is an enlarged overhead view of a first end portion of the release mechanism apparatus. The three restraining wall elements 32*a*, 32*b*, 32*c* are substantially identical and substantially symmetrical. They come close together at the apex of the cage-like element 34, their tops are beveled, so that cumulatively they form an aperture 36.

Figure 3:
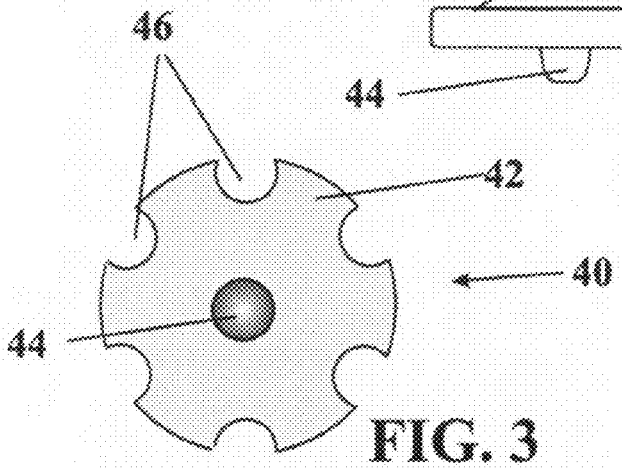
FIG. 3 is a bottom view of a firing pin with the invented release mechanism apparatus.

FIG. 3 is a bottom view of the firing pin 10 with the invented release mechanism apparatus. The second end portion 40 of the rod 20 further includes a depending coaxial vented plate 42. The vented plate is a base for a compression spring. The illustrated vents 46 are scalloped edges, however the shape of the vents is not limiting, so long as the vents 46 are sufficiently large to prevent the plate from pressurizing the air when the firing pin is actuated. The scalloped edges of the instant firing pin are advantageous as the edges are easier to mold than, for instance, a perforated plate. As illustrated in FIG. 3, the second end portion 40 of the rod is terminated with a protruding somewhat flat-headed pin 44. The pin 44 is an excellent striker, providing substantially complete ignition.

Figure 6:
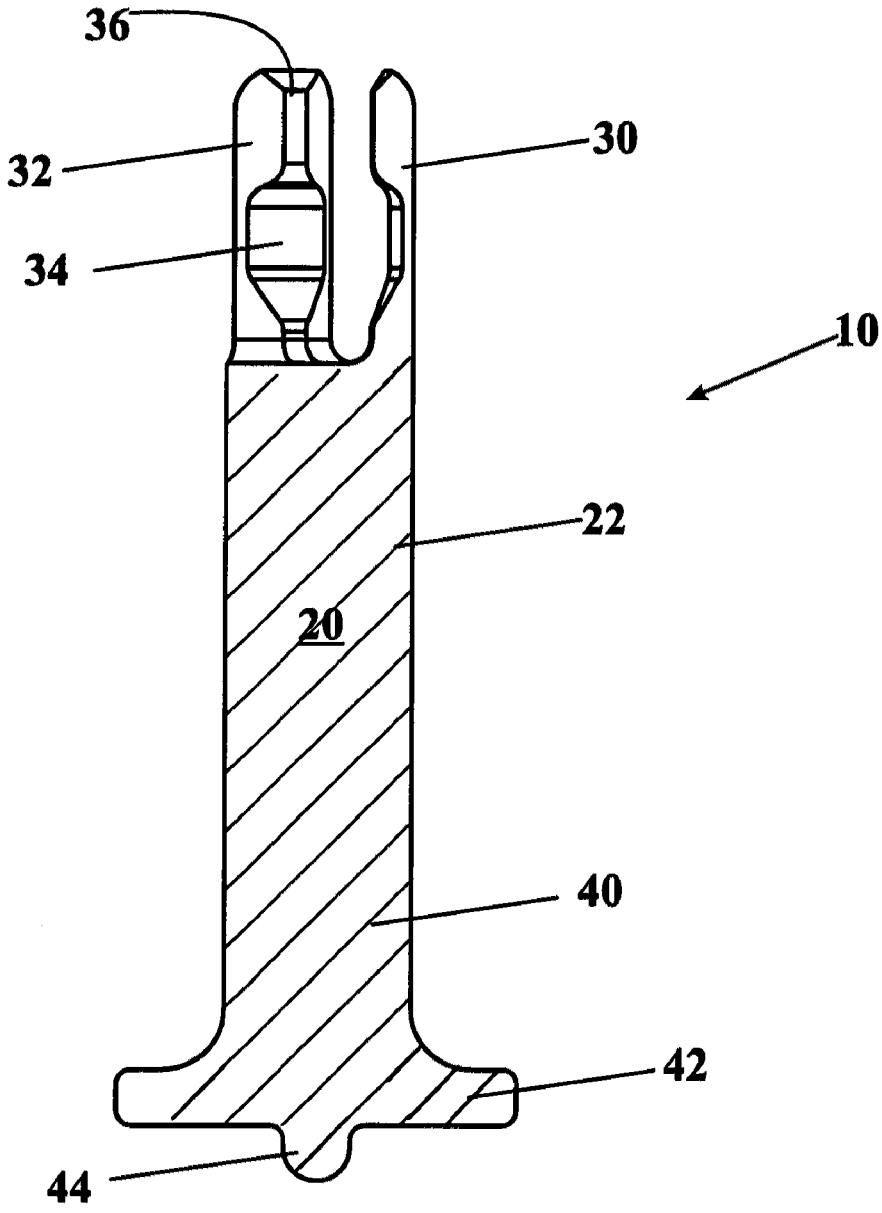
FIG. 6 is a longitudinal cross-sectional view of the firing pin with an invented release mechanism apparatus, where the first end portion of the release mechanism apparatus is partially cut away to illustrate a variation of the geometry of release mechanism apparatus, where the geometry is suited for the illustrated cable and an attached stop element.

Deviating temporarily from the sequence, the reader is referred to FIG. 6. FIG. 6 is a longitudinal cross-sectional view of the firing pin 10 with the invented release mechanism apparatus, where the first end portion 30 of the release mechanism apparatus is partially cut away to illustrate a variation of the geometry of release mechanism apparatus. This geometry is suited for the illustrated cable and an attached stop element. As depicted, the cage-like element 34 has a substantially cylindrical shape with an attenuated top and bottom. The cage-like element 34 looks more like a blood pressure pump bulb than a cage, when one envisions a conventional cage. The stop element on a cable varies in shape, with a rounded element being the more common shape. Accordingly, the functionality of the release mechanism apparatus not limited to a specific shape of the stop element. The shape of the stop element is offset by having an aperture with a longer channel in communication with the cavity of the cage-like element 34, as the plurality of restraining wall elements 32 have greater leverage.

Referring to FIG. 4, which is a longitudinal cross-sectional view of the firing pin 1 with an invented release mechanism apparatus 10 seated in a restraining element 50, the apparatus has a cable 90 with an attached stop element 92. The cable 90 with an attached stop element 92 is secured and the firing pin is positioned in a pre-released, unloaded position. The rod 20 is seated in a restraining element 50 having an axial bore 52. The bore has at least two regions. A first region constrains the restraining wall elements 32 of the cage-like element 34 to a closed position (non-releasing). A second region 54 has an enlarged geometry where the restraining wall elements may elastically deform to an open position (releasing position), where, upon deformation, the volume of the chamber and the size of the aperture is increased sufficiently to release a connected cable terminated with the attached stop element 92. In the exemplary embodiment, the restraining element 50 also is threaded 56 for quick connection. Further, the restraining element 50 has a third region 58, which is an axial bearing for the depending coaxial vented plate 42 of the firing pin 10. The space between the rod 20 and the third region 58 is occupied by a spring 70. The illustrated spring 70 is a compression spring, and as shown in FIG. 4, the spring 70 is in a no/low load position.

Referring to FIG. 5, the release mechanism apparatus illustrated in FIG. 4 is shown with the firing pin 1 cocked and, at the instant, the firing pin is released. The compression spring 70 is fully compressed. The rod 20 has been moved to the second region 54 by pulling on the cable, which compresses the spring 70 as well as sliding the firing pin 1 into the release position. In the second region 54, there is no support for the restraining wall elements 32, and the cage-like element opens when the plurality of restraining wall elements elastically deform flexing outward (as shown by the arrows). Upon deformation, the volume of the cage-like element/chamber 54 and the size of the aperture 36 is increased sufficiently to release the connected cable 90 terminated with the attached stop element 92. Unless otherwise restrained, and when the cable is released, nothing restrains the firing pin. Accordingly, the spring accelerates the firing pin 1 through the third region stopping only upon impact of the pin 44 with a primer and the like of an energetic device.

In the case of use with an explosive device, for instance with a mine, there is no need to reset the releasing apparatus 10, as everything is destroyed. In other applications, where the releasing apparatus 10 is used over and over again, the cable may be reconnected by moving the rod to the second region, pushing the cable and the attached stop back into the cage-like element, and sliding the rod back to the first region. Accordingly, the plurality of restraining wall elements form the closed cage-like element, and the process is repeated over-and-over. Variations of the steps of positioning the cable in the releasing apparatus are anticipated.

A method for using a firing pin having an integral release mechanism apparatus as follows. Initially there is a step of positioning a cable with a stop element in the release mechanism apparatus of the firing pin such that the stop element is seated in cage-like element in a first end portion of the integral to the release mechanism apparatus. The firing pin is slid through an axial bore of a restraining element to a first region, where the first region constrains a plurality of restraining wall elements of the cage-like element, therein anchoring the cable in a no release position. Next the firing pin is fitted with the restraining element to an energetic device, such as an explosive device. The cable is pulled at a desired time, therein sliding the firing pin to a second region of the restraining element characterized in that the axial bore has an enlarged geometry. The sliding compresses a spring and moves the cage-like element to an unconstrained position where the restraining wall elements may elastically deform to an open position, releasing the cable and substantially simultaneously releasing the firing pin. The firing pin is accelerated through a third region, which houses the spring that now pushes the firing pin. The firing pin stops only upon impact of the pin with an ignition cap and the like.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A release mechanism apparatus, comprising:

a rod with a first end portion, a middle portion, and a second end portion, wherein said first end portion includes an integral cage-like element, wherein said cage-like element is comprised of a plurality of restraining wall elements to define an interior chamber with a volume sufficient to accommodate a cable stop element and defining an aperture, which is in communication with the interior chamber, and wherein the aperture includes a size to accommodate a cable, but small enough to prevent the cable stop element from passing while the plurality of restraining wall elements are constrained, even if the cable is under tension; and a restraining element comprising an axial bore with a first region for constraining the restraining wall elements of the cage-like element to a closed position, and a second region having an enlarged geometry, wherein the restraining wall elements elastically deform to an open position, and wherein the volume of the chamber and the size of the aperture is increased sufficiently to release a connected cable terminated with an attached stop element.

2. The release mechanism apparatus according to claim 1, wherein the apparatus is composed of a thermoplastic material.

3. The release mechanism apparatus according to claim 2, wherein the thermoplastic material is polyetheretherketone (PEEK).

4. The release mechanism apparatus according to claim 2, wherein the thermoplastic material has a low frictional coefficient.

5. The release mechanism apparatus according to claim 1, wherein said second end portion of the rod further comprises a depending coaxial vented plate.

6. The release mechanism apparatus according to claim 5, wherein the vented plate is a base for a compression spring of a firing pin.

7. The release mechanism apparatus according to claim 5, wherein the vented plate is a base for a compression spring of a firing pin, and wherein said second end portion of the rod further comprises a protruding pin.

8. The release mechanism apparatus according to claim 5, wherein said vented plate includes a protruding pin on an underside of the plate.

9. A firing pin having an integral release mechanism apparatus, comprising:

a thermoplastic rod comprising a first end portion, a middle portion, and a second end portion, wherein said first end portion includes an integral cage-like element, said integral cage-like element is comprised of a plurality of elastic restraining wall elements to define an interior chamber with a volume sufficient to accommodate a cable stop element and define an aperture, which is in communication with the interior chamber, wherein the aperture includes a size to accommodate a cable, but small enough to prevent the cable stop element from passing while the plurality of restraining wall elements are constrained, even if the cable is under tension, and wherein said second end portion comprises a depending coaxial vented plate that is a base for a spring that accelerates the firing pin, and a protruding pin on the underside of the vented plate that is an ignition pin.

10. The firing pin according to claim 9, further comprising a restraining element comprising an axial bore through which the firing pin slides, said axial bore comprises a first region and a second region, said first region constrains the restraining wall elements of the integral cage-like element to a closed position, wherein said second region have an enlarged geometry where the restraining wall elements elastically deform to an open position so that the volume of the chamber and the size of the aperture is increased sufficiently to release a connected cable terminated with an attached stop element, and wherein said third region houses the spring, said third region includes a diameter to serve as a bearing for the vented plate, and wherein the third region is substantially coaxial to the firing pin.

11. The firing pin according to claim 10, wherein the restraining element is composed of polyetheretherketone (PEEK).

12. The firing pin according to claim 9, wherein the thermoplastic rod is composed of polyetheretherketone (PEEK).

13. The firing pin according to claim 9, wherein the protruding pin is substantially flat headed, and wherein on impact with an ignition cap, the protruding pin produces substantially complete ignition of the cap.

14. A method for using a firing pin having an integral release mechanism apparatus, comprising:

positioning a cable with a stop element in the release mechanism apparatus of the firing pin where the stop element is seated in cage-like element in a first end portion integral to the release mechanism apparatus;

sliding the firing pin through an axial bore of a restraining element to a first region, where the first region constrains a plurality of restraining wall elements of the cage-like element, therein anchoring the cable in a no release position;

fitting the firing pin with the restraining element to an energetic explosive device;

pulling on the cable at a desired time, therein sliding the firing pin to a second region of the restraining element characterized in that the axial bore has an enlarged geometry, said sliding compresses a spring and moves the cage-like element to an unconstrained position where the restraining wall elements elastically deform to an open position, releasing the cable and substantially simultaneously releasing the firing pin; and accelerating the firing pin through a third region, which houses the spring that is now pushing the firing pin, said firing pin stops only upon impact of the pin with a primer.

15. The method according to claim 14, wherein said restraining element is composed of polyetheretherketone.

16. The method according to claim 14, wherein said firing pin is composed of polyetheretherketone.

17. The method according to claim 14, wherein said firing pin includes a vented plate that is a base for the spring.

18. The method according to claim 17, wherein during said accelerating said firing pin, air flows past the vented plate through the vents.

19. The method according to claim 17, further comprising repeating the steps.

20. The method according to claim 17, wherein during said accelerating said firing pin, air flows past the vented plate through the vents, and wherein the energetic device exists during firing of the primer.

* * * * *